US005794846A

United States Patent [19]

Barrett

[11] Patent Number: 5,794,846

[45] Date of Patent: Aug. 18, 1998

[54] MODEL RAILROAD TRACK ALIGNMENT APPARATUS

[75] Inventor: Michael C. Barrett, Austin, Tex.

[73] Assignee: Black Bear Construction Company, Inc., Austin, Tex.

[21] Appl. No.: 720,681

[22] Filed: Oct. 2, 1996

[51] Int. Cl.[6] ..... A63H 19/30

[52] U.S. Cl. ..... 238/10 E; 104/126

[58] Field of Search ..... 238/10 R, 10 A, 238/10 B, 10 C, 10 E, 10 F; 107/DIG. 1, 126

[56] References Cited

U.S. PATENT DOCUMENTS

| | | | |
|---|---|---|---|
| 3,750,945 | 8/1973 | Warr | 238/10 E |
| 4,496,100 | 1/1985 | Schwager et al. | 238/10 F |
| 4,540,119 | 9/1985 | Neuhierl | 238/10 F |
| 4,941,610 | 7/1990 | Frauca | 238/10 F |
| 4,953,785 | 9/1990 | Keska | 238/10 E |
| 5,139,198 | 8/1992 | Niehoff | 238/10 E |
| 5,370,308 | 12/1994 | Black | 238/10 E |
| 5,579,997 | 12/1996 | Jackson et al. | 238/10 F |

FOREIGN PATENT DOCUMENTS

| | | | |
|---|---|---|---|
| 3402726 | 8/1985 | Germany | 238/10 F |

*Primary Examiner*—S. Joseph Morano

*Attorney, Agent, or Firm*—Conley, Rose & Tayon; B. Noel Kivlin

[57] ABSTRACT

Track alignment apparatus for supporting and linking sections of model railroad track and/or for receiving a model railroad trestle. Track alignment apparatus may include one or more track alignment members to engage trestles, provide rigidity to curved or straight model railroad track, and/or connect model railroad track to a layout base.

22 Claims, 11 Drawing Sheets

Top View

Bottom View

Bottom View

Bottom View

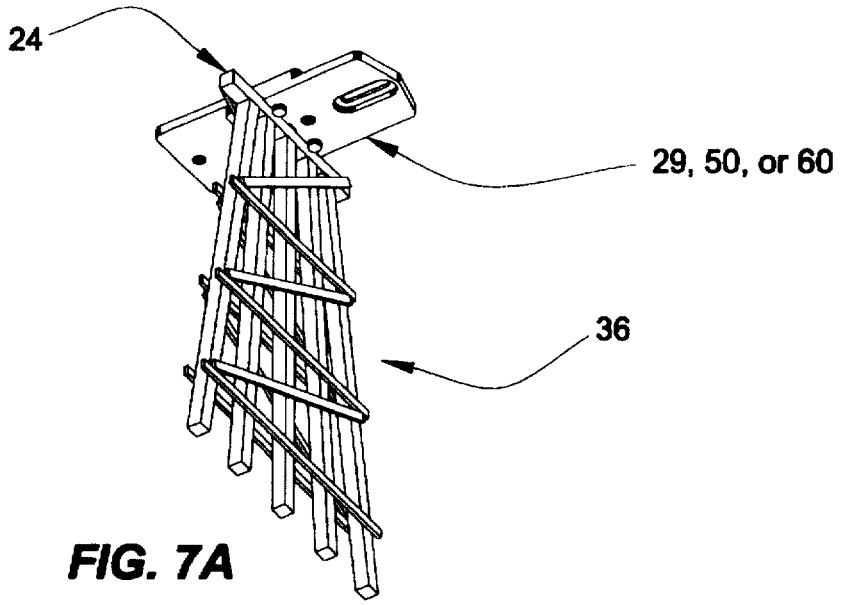
FIG. 7A
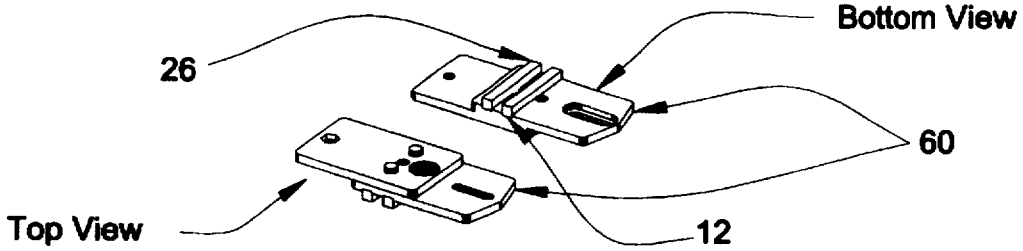
FIG. 7B(i)
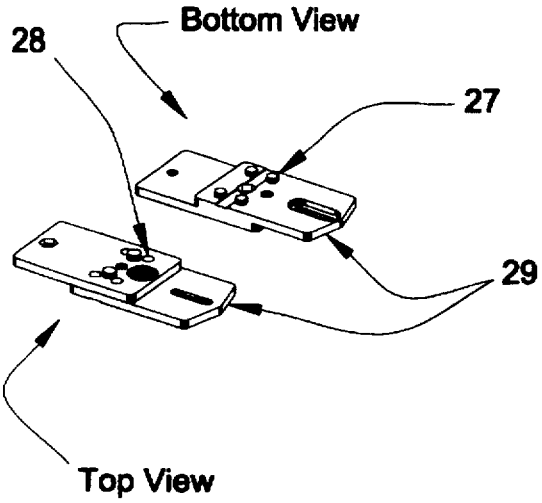
FIG. 7B(ii)
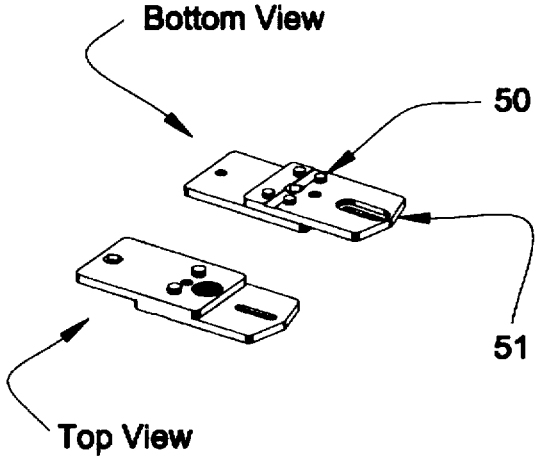
FIG. 7B(iii)

MODEL RAILROAD TRACK ALIGNMENT APPARATUS

BACKGROUND OF THE INVENTION

1. Field of the Invention

The present invention generally relates to methods and apparatus for supporting and linking sections of model railroad track. More particularly, in one embodiment of the invention, a track alignment joint provides a mechanical connection between two sections of a model railroad track. In another embodiment, a track alignment member is concealed within a cork roadbed and serves to attach a section of model railroad track to a layout base. In yet another embodiment, a track alignment joint provides rigidity to a section of flexible model railroad track, allowing the flexible track to be used in a floor layout without the need for a layout base. In another embodiment of the invention, a track alignment member is used to facilitate the positioning of a model railroad trestle. The above-mentioned embodiments may be used in combination with one another.

2. Description of the Related Art

Traditional, segmented model railroad track tends to have reliability problems when it is used in temporary floor layouts. Typically, clips or rail joiners are used to connect the sections of track, providing both the mechanical connection and the electrical connection between track sections. Repeated assembly and disassembly of the track sections, along with the vibration and flexure inherent in the use of a model railroad track, tends to cause the clips to spread open and create a break in the electrical circuit. The reduced rigidity of the loosened connection also makes the derailment of a model train more likely.

Major track manufacturers have recently developed interlocking sectional track that has roadbed integrated with the track itself. Typical trade names are True-Track® (Atlas), E-Z Track® (Bachmann), Power-Loc® (Lifelike), and C-Track® (Marklin). These roadbed-track products provide a mechanical means for joining the track sections together that is independent of the electrical connection provided by the common rail joiners. One drawback to the integrated roadbed-track systems is that they mate only with components of the same type, which are available in limited lengths and radii.

Flexible model railroad track generally has more utility than sectional track because it can be bent to any radius or used straight. Flexible model railroad track is also typically employed in longer sections, thereby reducing the number of electrical connections and improving the operational reliability of the track. However, flexible track is usually attached to a rigid base to prevent it from returning to its pre-curved condition. Conventional methods of rigidizing flexible track tend to make track disassembly and storage difficult. In addition, model railroad operation on a permanent layout typically creates a vibration that can cause track connectors to loosen, which tends to cause electrical discontinuities and/or derailment because of the loosened connections between sections of track.

One of the most difficult elements of constructing a trestle on a model railroad layout is positioning the trestles so that the top of each bent lines up with the stringers and track of the completed railroad. While each bent is being bonded onto the layout base, it must be held motionless, vertical, and evenly spaced with the other bents in the trestle to be properly positioned.

SUMMARY OF THE INVENTION

The present invention is directed to track alignment members, joints, and chains that overcome many of the disadvantages and drawbacks of the prior art.

An embodiment of the invention relates to a track alignment joint member for positioning a model railroad trestle. The joint member has a frontal end and a distal end and may have a recess in its top surface proximate the distal end and a recess in its bottom surface proximate the frontal end. The joint member preferably has a connector proximate the distal end that is adapted to join the joint member with another joint member such that the joint members may pivot in relation to one another. The joint member also preferably includes a trestle alignment structure adapted to receive a portion of a model railroad trestle. The joint member may have an engagement device on its top surface that fits between the ties of a section of model railroad track to provide a fixable engagement between the joint member and the section of track.

Another embodiment relates to a track alignment joint for supporting model railroad track. The joint includes two members that each have a frontal end, distal end, a top surface having a recess proximate the distal end, and a bottom surface having a recess proximate the frontal end. Each of the members preferably has a connector on its top surface that provides a fixable engagement between the member and a section a model railroad track. The joint preferably includes a connector that provides a pivotal engagement between the top indention of the first member and the bottom indention of the second member. It is preferred that the members are capable of pivoting in relation to one another at least to a degree that an angle between about 5° and about 20° may be formed between the lengths of the members. The joint members each may have a distal opening proximate the distal end, a frontal opening proximate the frontal end, and/or a central opening substantially between the distal opening and the frontal opening. Each of the openings preferably is adapted to hold and receive a connector. Each of the joint members may have an engagement device on its top surface that fits between the ties of a section of model railroad track to provide a fixable engagement between the member and the section of track.

Yet another embodiment of the invention relates to a model railroad track system that includes a track alignment joint and a section of railroad track. The track alignment joint may be connected to additional members to form a segmented chain. Preferably, adjacent joint members are connected such that a pivotal engagement exists between the joint members. The chain preferably is shaped to conform to the shape of the model railroad track.

Embodiments of the invention may be used in conjunction with standard sectional track and/or flexible track. Embodiments of the invention provide a rigid mechanical attachment between the sections of track and/or to the base (e.g., table top, roadbed) of the model railroad. Embodiments of the invention provide rigidity within and between sections of flexible track while allowing for disassembly of the track at certain joints to allow compact storage. Embodiments of the invention facilitate the construction of curved and/or straight model railroad trestles by maintaining trestles motionless in a desired position as they are bonded to a layout base. Embodiments of the invention provide sufficient rigidity to flexible track to allow it to be used independently of a conventional layout base.

One aspect of the invention relates to a track alignment joint for providing a mechanical connection between sections of model railroad track that is independent of the electrical connections.

Another aspect relates to a pivotal track alignment joint for rigidizing flexible model railroad track.

Yet another aspect relates to a chain of track alignment joints that substantially conforms to the shape of a section of flexible track.

Still another aspect relates to a track alignment member for facilitating the positioning and construction of model railroad trestles.

Another aspect of the invention relates to a track alignment member for connecting a section of model railroad track to model railroad scenery support.

Further aspects and advantages of the present invention will become apparent to one skilled in the art upon review of the following detailed description of the preferred embodiments.

DESCRIPTION OF THE DRAWINGS

FIG. 7A–C illustrates the engagement of the track alignment members and a model railroad trestle in one embodiment.

DESCRIPTION OF THE PREFERRED EMBODIMENTS

Figure 1A:
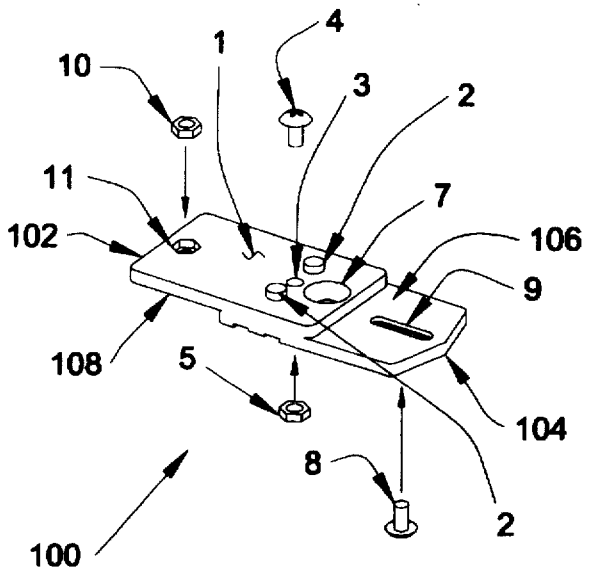
FIG. 1 depicts top and bottom views of embodiments of a track alignment member.
Figure 1B:
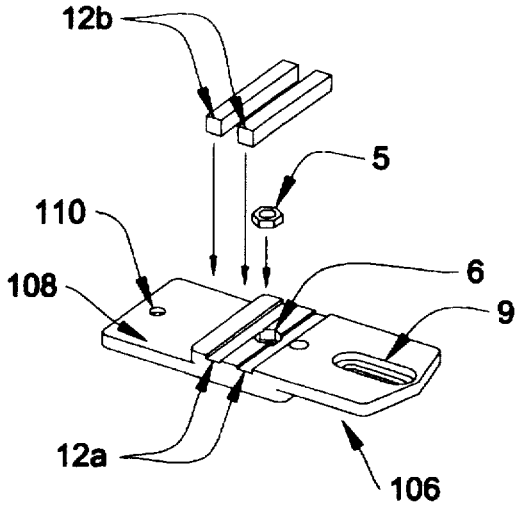

An embodiment of a track alignment member (100) is shown in FIG. 1. FIG. 1*a* shows a member having a frontal end (102) and a distal end (104). The member preferably has a top recess (106) proximate the distal end and a bottom recess (108) proximate the frontal end. The top surface (1) of the member may rest against the base of a model railroad track. Member (100) preferably has a distal opening proximate the distal end, a frontal opening proximate the frontal end, and a central opening substantially between the frontal opening and the distal opening. The frontal, distal, and central openings are each preferably adapted to receive and hold a connector. In one embodiment, the frontal, distal, and central openings are tapped holes. The frontal opening may be an opening (110) shown in FIG. 1*b* or it may be cavity (11) shown in FIG. 1*a*. In an embodiment, the central opening is opening (3) shown in FIG. 1*a*. In an embodiment, the distal opening is slot (9) shown in FIG. 1*a*.

Figure 3A:
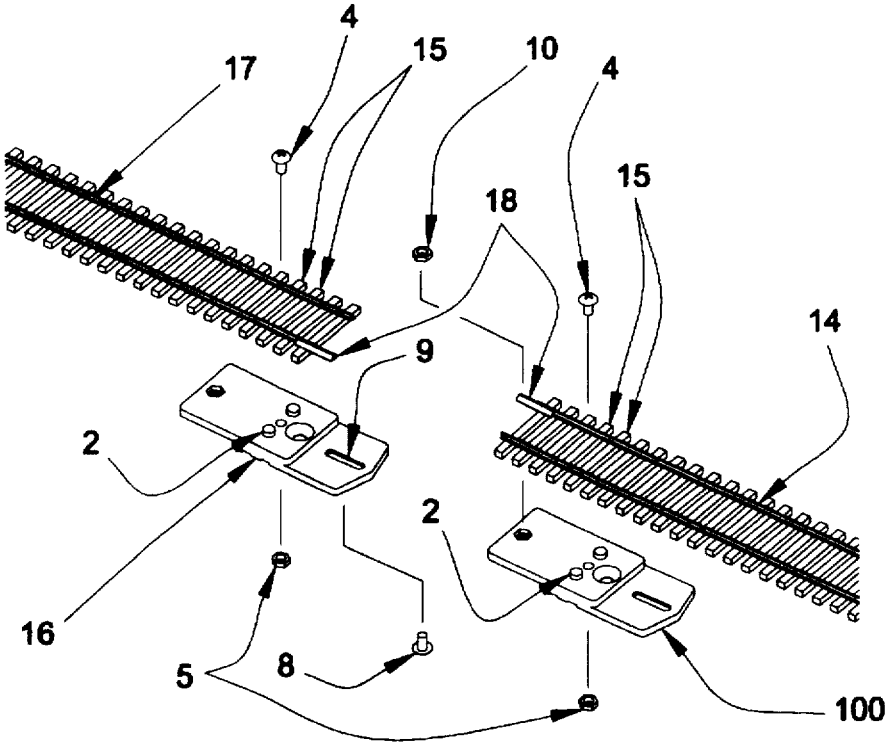
FIG. 3 illustrates the use of track alignment members to join sections of model railroad track.

In an embodiment, member (100) contains an engagement device on its top surface to facilitate a connection between the member and the model railroad track. The engagement device may be one or more lugs (2) protruding from the top surface of the member to fit within and engage the ties (15) of a model railroad track (shown in FIG. 3*a*). The lug(s) may be of various shapes (e.g., rectangular, circular, etc.) and have sizes significantly larger or smaller than those shown in FIG. 1*a*. The lug(s) may be removed for applications in which a flat top surface is desired. In an embodiment shown in FIG. 1*a*, an opening (3) substantially between the two lugs shown accepts a connector which clamps the track to the member by engaging the ties of the track. The connector is preferably a screw (4) or a clip. The opening (3) may be tapped or a nut (5) may be inserted into cavity (6) to secure the screw and track to the member (100). In one embodiment, opening (3) extends through a portion of an engagement device (e.g., a rectangular lug) protruding across the top surface of member (100). The member may include an opening (7) adapted to receive a connector for fastening the member to the base material of a model railroad layout. The opening (7) is preferably countersunk or counterbored to allow the head of the connector to recede below the top surface of the member.

In an embodiment, two track alignment members may be fastened together to form a track alignment joint. A number of the members (or joints) may be fastened together to form a segmented chain. The members are preferable linked together by one or more connectors. The connector is preferably a screw (8) passing through a hole or slot (9) of a first member into a tapped hole or a captured nut (10) in the cavity (11) of an adjacent second member.

Figure 2A:
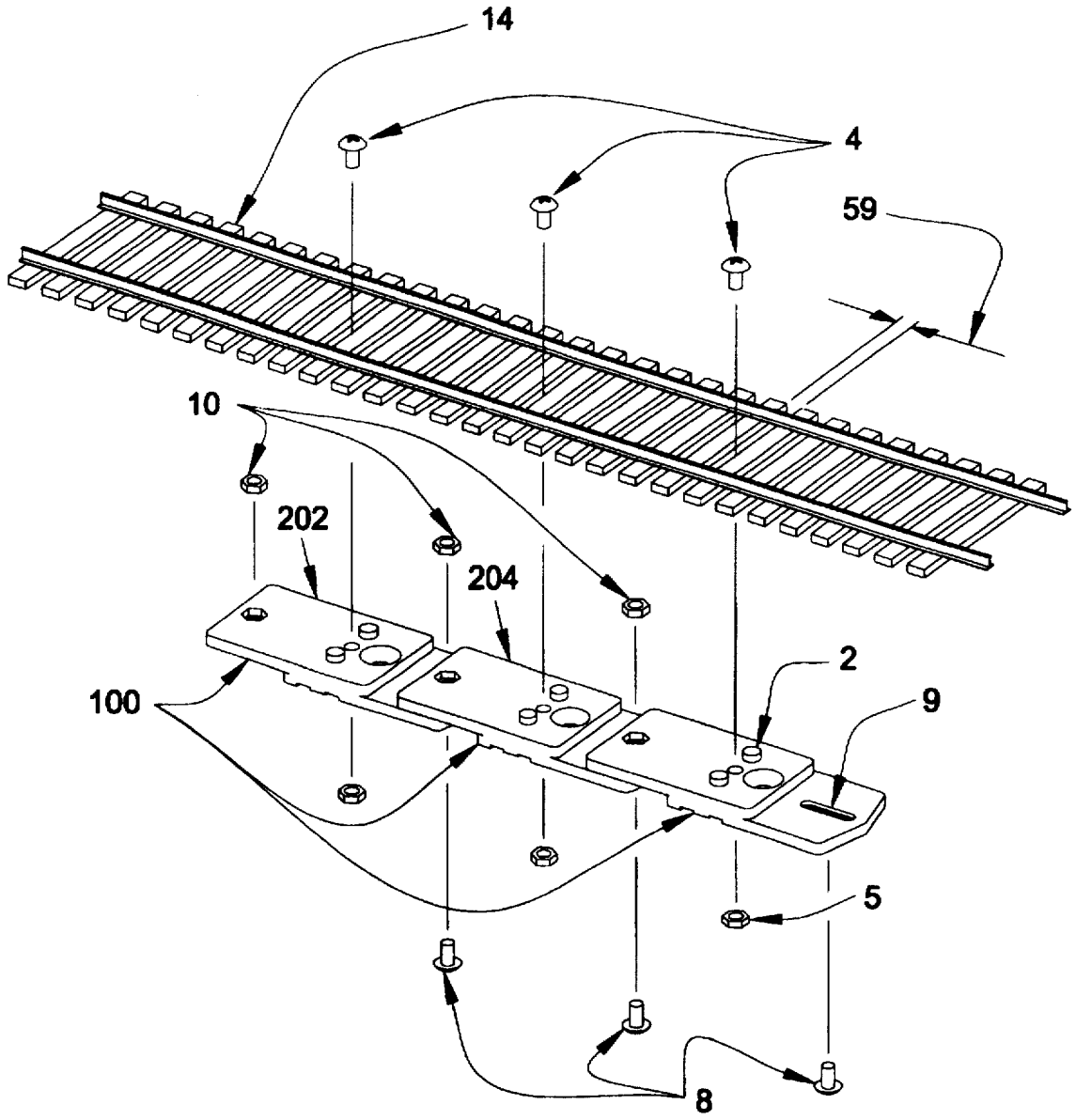
FIGS. 2*a–c* depict a section of model railroad track equipped with a chain of track alignment members.

FIG. 2*a* shows an embodiment in which a series of track alignment members are joined in a segmented chain and connected to a section of model railroad track (14). Adjacent members may be jointed by a screw (8) and nut (10) or other suitable connector(s) that allows the members to pivot about a vertical axis located at the connector. The members preferably are adapted to pivot in a horizontal plane that is substantially parallel to the top surface of the members. It is preferred that the members be able to pivot at least to a degree such that an angle between about 5° and about 20° having a vertex in the vicinity of the connector is formed between the members. In one embodiment, the members are pivotal such that a substantially perpendicular angle having a vertex in the vicinity of the connector is formable between the members. The members may be pivoted to form an arc segment such that a joint or chain may substantially conform to the shape of the section of railroad track to which it is attached. The connector may be tightened to inhibit the pivoting of the members and cause adjacent members to be rigidly attached at a desired angle.

It is preferred that at least a portion of the top recess (106) of member (202) be pivotally engaged with at least a portion of the bottom recess (108) of member (204). The top recess (106) and bottom recess (108) are preferably sized such that the top surfaces of first member (202) and second member (204) preferably line up together to form a substantially level surface. In an embodiment, a connector can slide along slot (9) to change the position of the pivotal joint and/or modify the distance between the lugs of adjacent members to facilitate lining up the lugs (2), screws (4), and/or nuts (5) when attaching the members to the track. If it is impossible to line up the lugs (2) of a member of a joint or chain with the space between the ties (59), then the lugs (2) of the member may be removed by filing or cutting. Although it may not be directly attached to the track by an engagement device, the member may continue to provide rigidity and spacing by remaining rigidly attached to adjacent members.

Figure 2B:
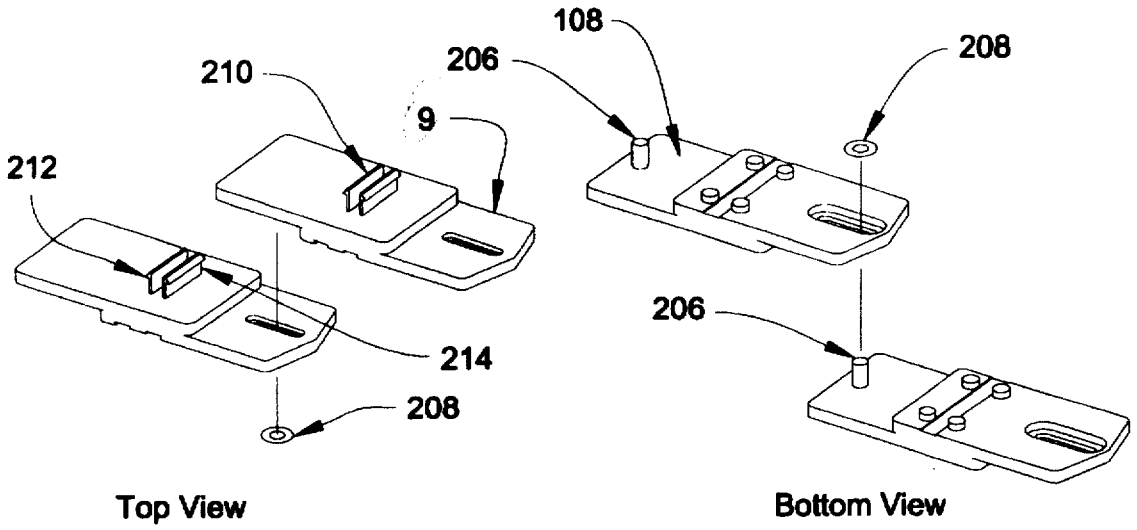

In an embodiment of the invention shown in FIG. 2*b*, adjacent track alignment members are pivotally engaged by a stud (206) and clip (208). The stud may be located on the bottom surface of one of the alignment members and preferably protrudes from bottom indention (108). The stud may be inserted through slot (9) and the clip preferably at least substantially surrounds the stud to maintain a portion of the stud within the slot, thereby allowing a pivotal connection between the adjacent alignment members.

In an embodiment illustrated by FIG. 2*b*, an engagement device extends from the top surface of the alignment member and has two opposing sections (210) that each have a beveled portion (212) and a base (214). The bases of the two sections may be spaced apart at a distance less than or about equal to the space between the ties of a section of model railroad track. In this manner, the bases of the sections fit within the ties. The distance between the beveled portions of the opposing sections may be greater than the distance between the ties. The two sections may be adapted to flex such that the distance between the beveled portions of the opposing sections decreases when a force is applied to one or both of the beveled portions. It is preferred that the flexing of the sections causes the distance between the beveled portions to become about less than or equal to the distance between the ties as the sections are inserted within the ties. After the beveled portions have been inserted beyond the ties, the sections preferably return to their unstressed (i.e., pre-flexed) position such that the distance between the beveled portions is greater than the distance between the ties, with the beveled portions each engaging a tie to maintain the alignment member in engagement with the section of model railroad track. In an alternate embodiment, the sections (210) may be relatively inflexible, and the ties of the model railroad track flex to allow the insertion of the sections within the ties.

Figure 2C:
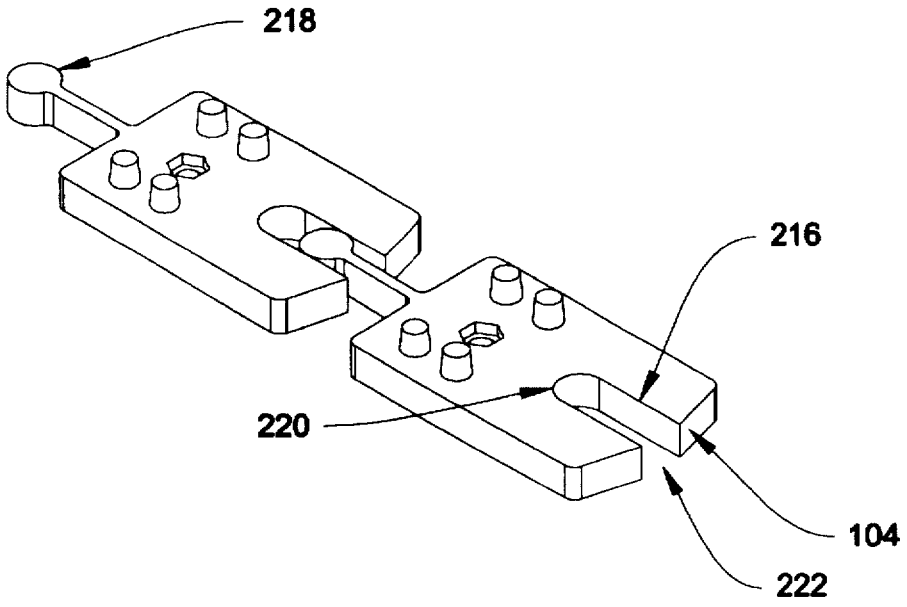

In an embodiment shown in FIG. 2*c*, adjacent track alignment members are connected by an open slot (216) and a tongue (218). The open slot preferably narrows in the vicinity of distal end (104). The open slot preferably has a closed end (220) having a width greater than the width of the tongue and an open end (222) that has a width less than that of the tongue. In this manner, the tongue may be fitted within the open slot at the closed end and positioned between the closed end and the open end. The tongue is preferably maintained within the slot between the closed end and the open end by a frictional connection between the tongue and the slot. It is preferred that a pivotal connection exist between adjacent members at the location that the tongue engages the open slot such that the members may pivot in a substantially horizontal plane relative to one another.

Figure 3B:
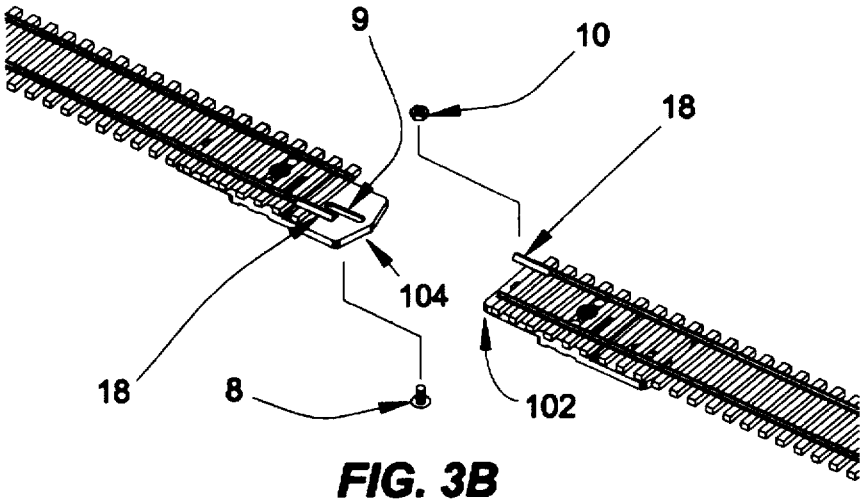
Figure 3C:
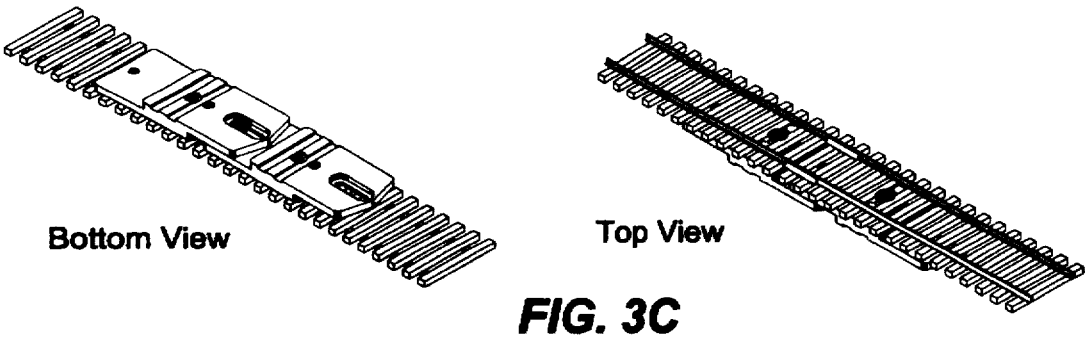

FIG. 3 shows two sections of adjacent track joined by track alignment members (100) and (16), each of which is connected to the end of a track section. One member may be attached to one section of model railroad track (14) by registering the lugs (2) in the appropriate spaces between the ties (15) and securing it with a screw (4) and nut (5). Member (100) is preferably secured to the section of track such that its frontal end extends past the end of the section of track as shown in FIG. 3*b*. Another member (16) may be attached to a second section of model railroad track (17) by registering the lugs (2) in the appropriate spaces between the ties (15) and securing them with another screw (4) and another nut (5). Member (16) is preferably secured to the section of track such that its distal end extends beyond the end of the section of track as shown in FIG. 3*b*. The track sections may be connected by sliding the rail joiners (18) over the rails, locating the elongated slot (9) under the nut (10) and installing the screw (8). Making similar connections between all the adjacent rail sections establishes a mechanically connected track that does not rely on the electrical contacts for its rigidity.

Figure 4:
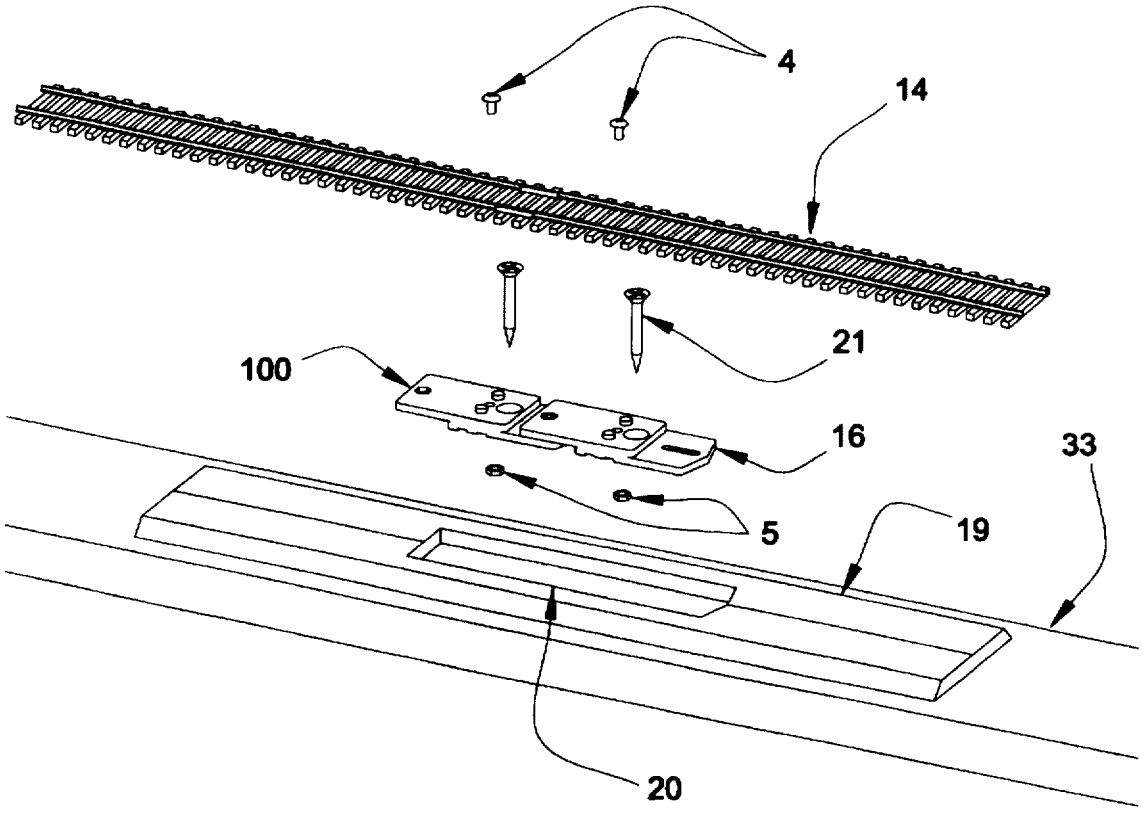
FIG. 4 illustrates the use of track alignment members to mount a section of model railroad track onto a cork roadbed.

The track may be operated free of any connection to a horizontal surface or it may be installed on a table top or similar surface. FIG. 4 illustrates the installation of track (14) joined with members (100) and (16) onto a cork roadbed (19) that has been glued onto a sub-roadbed (33) to create a finished model railroad. The height of the members is preferably substantially equal to the thickness of conventional cork roadbed. After the members (100) and (16) have their relative positions established, screw (8) may be tightened. After the location of the pair of members (100) and (16) on the cork roadbed (19) has been determined, an appropriately shaped opening (20) may be cut in the roadbed. Members (100) and (16) preferably fit within opening (20) such that the members are at least partially concealed within the cork roadbed (19) and the top surface of the members lines up with the surface of the roadbed to form a substantially level surface. Removing the track attachment screws (4) allows two flat head screws (21) or other connectors to secure the members (100) and (16) to the sub-roadbed (33). Similar attachment of the remaining members may serve to create a substantially permanent model railroad.

Flexible model railroad track is the most versatile track available because it can be formed into any radius desired. Also, since it is provided in longer lengths, there are fewer electrical connections making it electrically more reliable. The use of relatively long segments of flexible track is generally less expensive than using individual joints of track. However, flexible track tends to require a permanent layout because it usually needs to be nailed or glued in place in order to hold its shape.

On a permanent model train layout, it is common to have problems with rail joiners and track attachments working loose due to vibration. Vibration may loosen the small nails typically used for track attachments. On a temporary floor layout, this problem tends to worsen because the common rail joiner is required to provide both mechanical and electrical connection between track sections.

Members (100) can hold the shape of flexible track, allowing it to be used in a temporary floor layout and disassembled. The members (100) also can form the rigid connections between sections of track. Thus, a floor layout using members (100) can have many of the benefits and features of a rigid, integrated roadbed track, while having the versatility of flexible track.

Figure 5A:
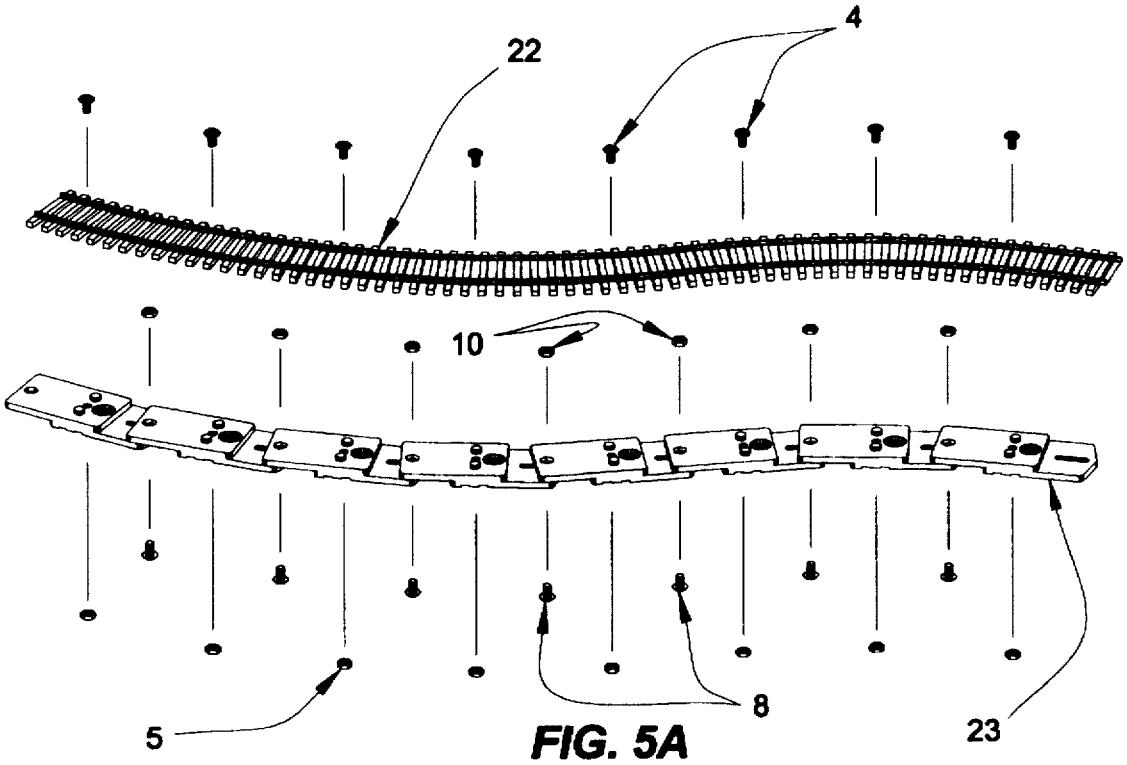
FIG. 5 illustrates the use and construction of a track alignment chain in an embodiment to increase the rigidity of a section of flexible model railroad track.
Figure 5B:
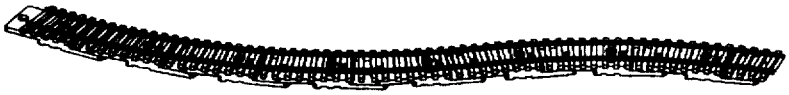

FIG. 5 shows an embodiment in which a section of flexible track (22) is equipped with a plurality of track alignment members (23). Each of the members may be attached to its neighboring member with a screw (8) and nut (10) or other similar connecting device, and each member may be attached to the flexible track with a screw (4) and nut (5) or other similar connecting device. In an embodiment, the connector extends through the distal opening of a first member and through the frontal opening of a member adjacent to the first member. After the members are connected, they can be glued together for additional rigidity. In an embodiment, glue is placed where the top indention of one member engages with the bottom indention of an adjacent member. The flexible track can also be glued to the chain of members. A track layout made rigid in this manner need not be disassembled for storage. The track alignment joints and chains are well-suited for curved sections of flexible model railroad track since the pivoting of adjacent members may allow a joint or chain to substantially conform to any angle or radius that flexible model track may take.

Figure 6:
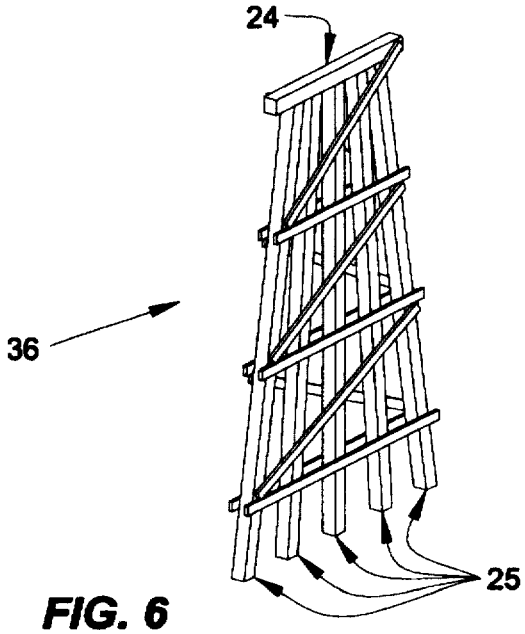
FIG. 6 depicts an embodiment of a model railroad trestle.

Using the track alignment members can greatly facilitate the installation of trestles on a model railroad. It is to be understood that for the purpose of this description the term "trestle" is taken to mean a support member or frame used for supporting a track. Trestles may be used individually but are typically arranged in series. FIG. 6 shows some of the key features of a typical trestle (36). Specially modified members (shown in FIG. 7) are adapted to hold and register the trestle top cap (24) while the trestle legs (25) are moved to a vertical position, held motionless, and bonded in place.

In an embodiment, the track alignment member (100) includes a trestle alignment mechanism for receiving a portion of a model railroad trestle. In an embodiment shown in FIG. 1*b*, rectangular rods (12*b*) may be inserted into grooves (12*a*) in the bottom of the member and may be glued into the grooves when the member is used in trestle building applications. A portion of a trestle may be inserted between the rectangular rods and may be fixably secured within the rods. In an embodiment, the members are molded or cast with a trestle alignment portion such as protrusions on the bottom surface of the member such that a portion of a trestle may be received between the protrusions. These protrusions may be of various shapes (e.g., rectangular, circular) and may have sizes significantly larger or smaller than the rods shown in FIG. 1. In another embodiment, a portion of the bottom surface of member (100) contains at least one trestle indention that has a width substantially equal to that of a portion of a trestle such that the portion of the trestle rests within the trestle indention. In an embodiment, the trestle alignment portion (e.g., trestle indention, protrusion) is substantially between the top indention and the bottom indention of member (100).

Figure 1C:
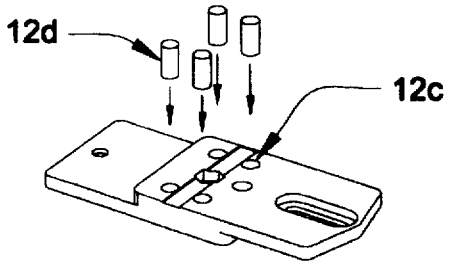
Figure 1D:
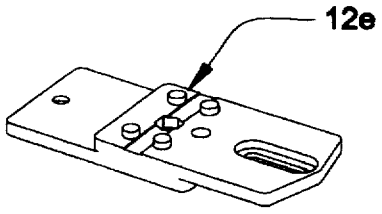

Alternative embodiments having configurations for trestle-building applications are shown in FIGS. 1*c* and 1*d*. FIG. 1*c* shows a track alignment member having openings (12*c*) instead of grooves (12*a*) that accept segments of round rod (12*d*) rather than segments of rectangular rod (12*b*). FIG. 1*d* shows the trestle alignment portion (12*e*) molded into the track alignment member. In this case, the modeler can cut off the features (12*e*) in applications where they are not desired.

FIG. 7 shows various embodiments in which members (100) have been fitted with a trestle alignment portion for engaging the top cap (24) of a trestle (36). The trestle alignment portion preferably engages the top cap (24) of a model trestle and maintains the cap substantially perpendicular to the longitudinal axis of a section of model railroad track. The trestle (36) extends from member (100), and the engagement of the top cap (24) and the trestle alignment portion preferably maintains a substantially perpendicular angle between the bottom surface of the member and the trestle. FIG. 7*b*(i) shows sections of rectangular rods (26) glued into depressions (12) in the bottom of the member (60). FIG. 7*b*(ii) shows round rods (27) glued into vertical holes (28) in a different style member (29). FIG. 7*b*(iii) shows round features (50) molded into the member (51). The features (50) can be filed off if the member (51) is to be used in applications requiring a flat bottom. The distance between the features (26), (27), or (50) preferably is substantially equal to the horizontal thickness of the trestle top cap (24).

In an embodiment, a plurality of joint members having at least one trestle alignment portion are used to secure a plurality of trestles to one or more sections of a model railroad track. The joint members may be connected to one another, or they may be unconnected and spaced apart. It is preferred that the joint members (whether connected together or not) be spaced such that the trestles engaged within the trestle alignment portions are evenly spaced and/or uniformly radially spaced when the trestles extend from a curved section of track. Of course, the joint members may be spaced such that the joint members are separated by an irregular spacing as well.

Figure 7C:
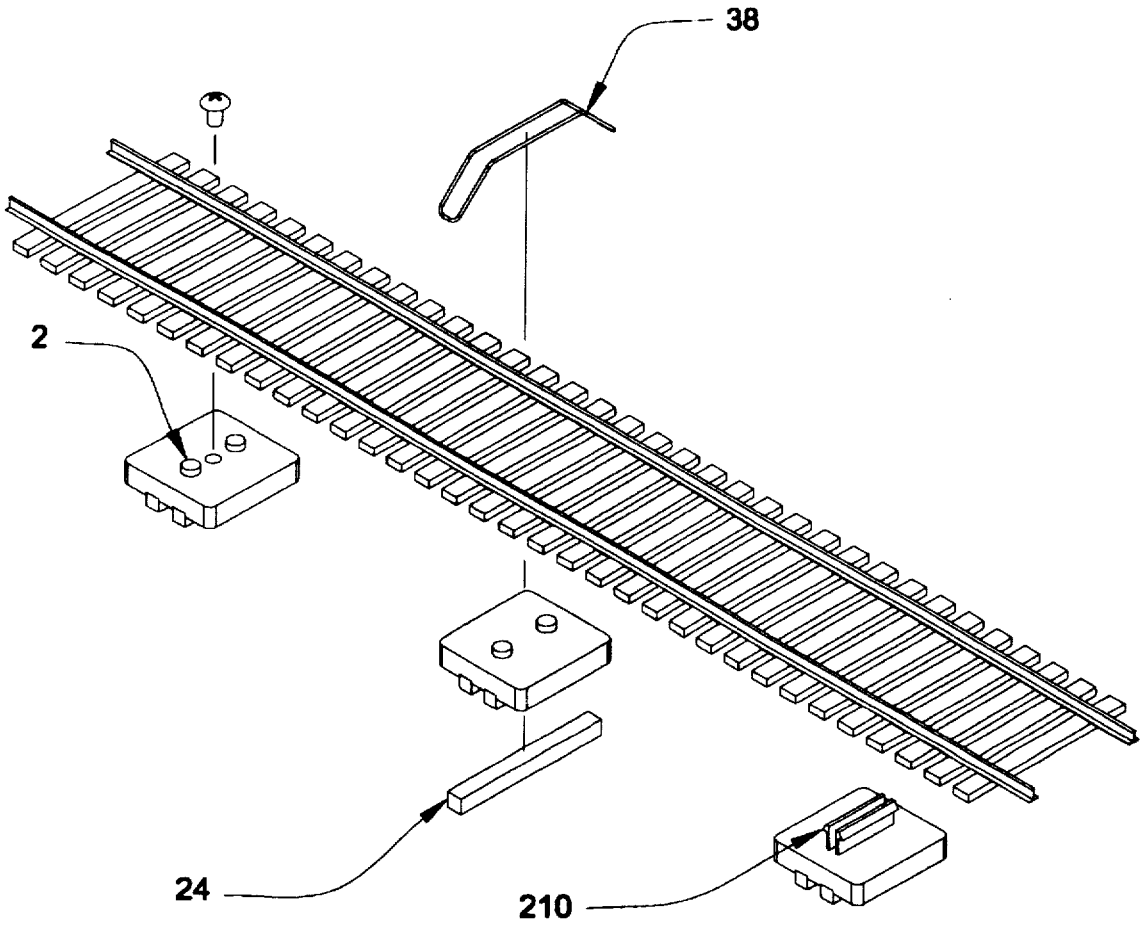

In an embodiment shown in FIG. 7*c*, single members are used to secure a portion of a trestle to a section of model railroad track. The member may have an engagement device (e.g., (2), (210), etc.) and a trestle alignment portion (e.g., (26), (27), (50), etc.). A band (38) (e.g., rubber band), clip, or similar device may be used to maintain an engagement between a portion of a model trestle and the member. The band may extend over a section of model track to maintain an engagement between the member and the track. It is to be understood that the alignment member may be used without an engagement device on its top surface in some cases. For instance, in an embodiment the alignment member is used to temporarily facilitate the positioning of model trestles beneath a section of model track. The member may be secured between the model track and a trestle via band (38). After the trestle is positioned, the member may be removed and a stringer may be used to support the model track.

Figure 8:
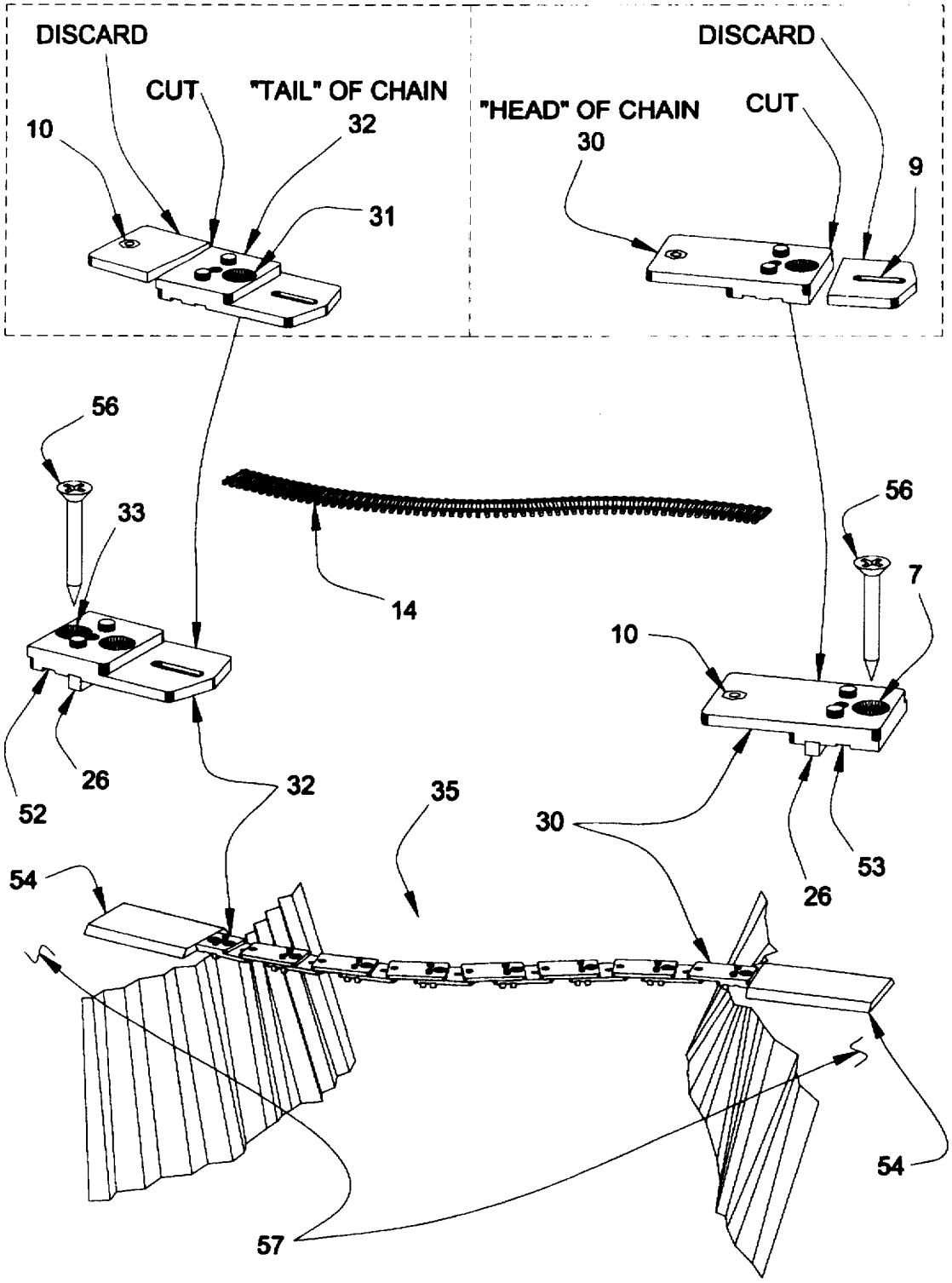
FIG. 8 illustrates the modification of the track alignment members to enhance their use with model railroad scenery support.

FIG. 8 illustrates the modification of the track alignment members on the ends of the chain (35) to facilitate attachment of the members to the scenery support (57) or subroadbed at each end of the trestle. The ends of the "head" member (30) and the "tail" member (32) may be cut off as shown. That is, the portion of the head member having the bottom recess (108) may be cut off, and the portion of the tail member having the top recess (106) may be cut off. The top cap registration feature(s) (e.g.(26),(27),(50), etc.) of the head member (30) are preferably not installed in the slot (53) or openings (12*c*) nearest the cut off end. The other registration feature(s) (e.g.(26),(27),(50), etc.) of the head member preferably are installed. The top cap registration feature (s) (e.g.(26),(27),(50), etc.) of the tail member (32) that is nearest the nut (10) are preferably not installed. The other registration feature(s) (e.g.(26),(27),(50), etc.) of the tail member preferably are installed. A second opening (33) (preferably countersunk or counterbored) that is adapted to receive and hold a connector may be formed into the tail member to allow attachment of the tail member to scenery support via the connector. Cork roadbed (54), or similar material, is preferably installed on the scenery support (57) at the approaches to the trestle to carry the track. The top cap registration feature(s) (e.g.(26),(27),(50), etc.) on the head (30) and tail (32) of the chain preferably engage the scenery support as shown in FIG. 8. It is preferred that the thickness of the members be such that the top of the chain (35) lines up with the tops of the cork roadbed sections (54) to form a substantially level surface.

In an embodiment, the curvature of the chain (35) is adjusted to match the curvature of the track (14), and the individual members are adjusted so that the pairs of registration features (26), (27), or (50) are substantially evenly spaced, lengthwise. The screws (8) or connectors that hold the joints together are tightened. Connectors (preferably flat head screws (56)) pass through the openings (7) and (33) and hold the head (30) and tail (32), respectively, rigidly to the scenery support (57). Thus, the entire chain (35) may be held horizontally over the desired location of the trestle.

Figure 9A:
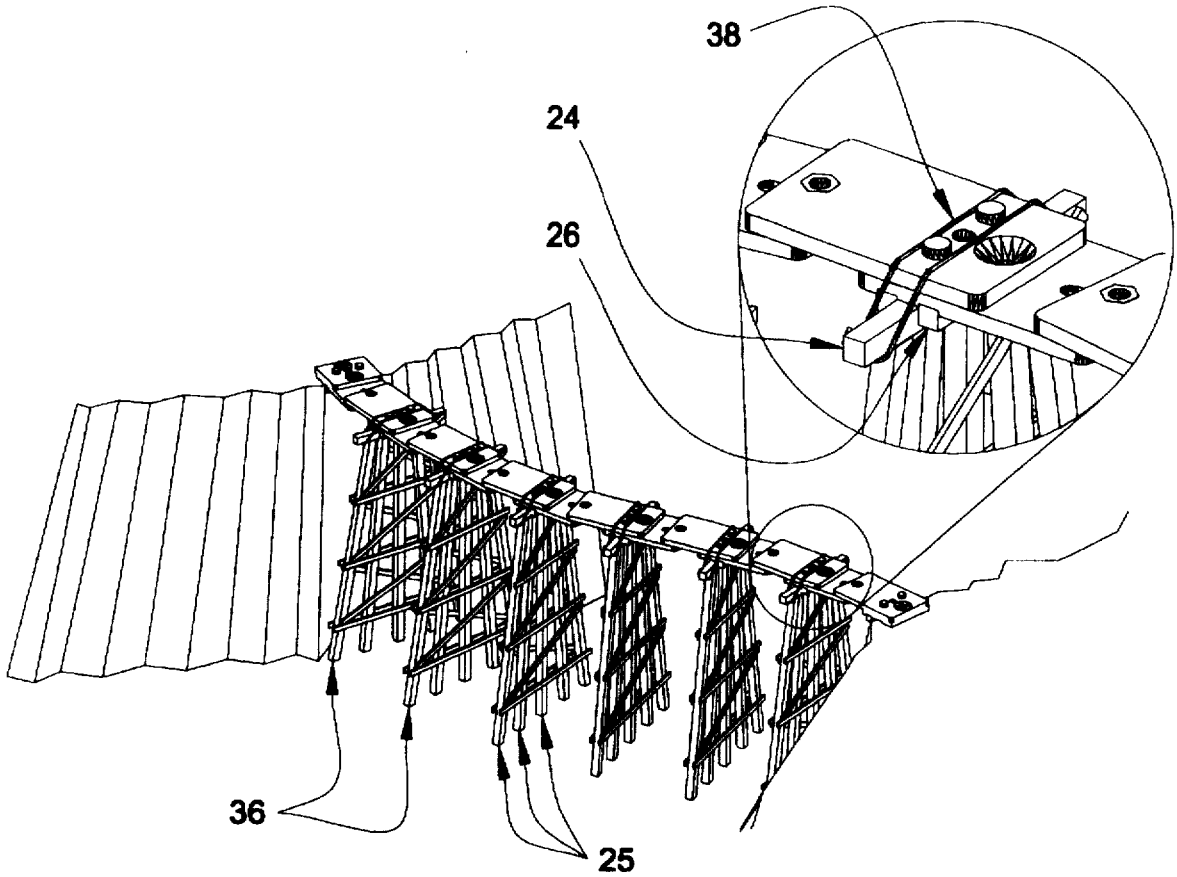
FIG. 9 illustrates the attachment of model railroad trestles and track alignment members in one embodiment.
Figure 9B:
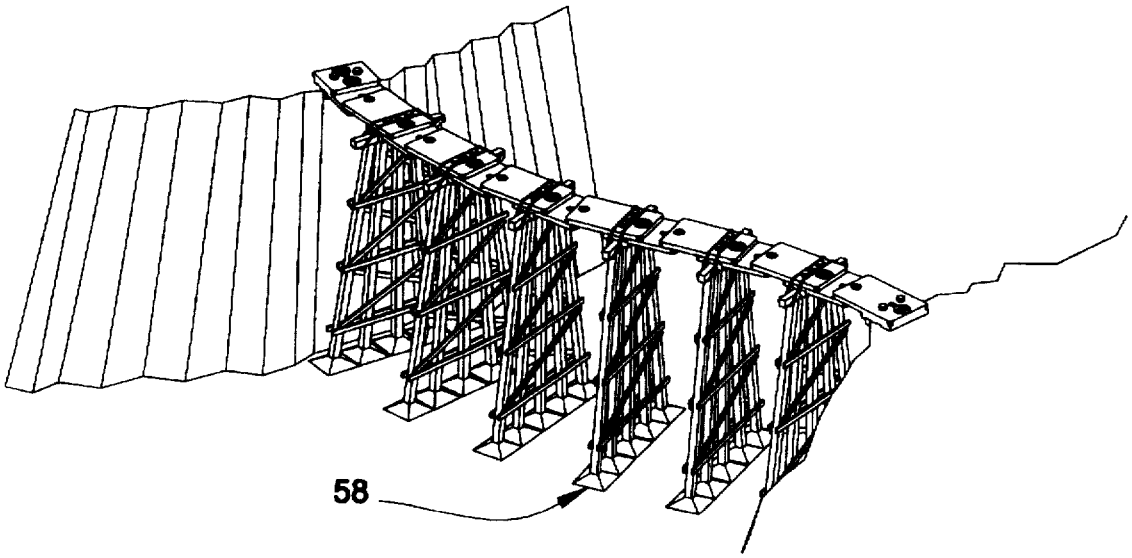

FIG. 9 illustrates an embodiment in which the trestle is fixably attached within a trestle alignment portion. The trestles (36) may be retained between the top cap registration features (26) or other trestle alignment portions (e.g., trestle indention, round rods (27), etc.) by a rubber band (38), clip, or similar device. As shown in FIG. 9, band (38) preferably engages trestle cap (24) and may substantially surround the lugs (2). It should be understood, however, that an engagement device (e.g., lug) does not have to be present for the connecting device (e.g., band, clip, etc.) to properly facilitate the engagement of the trestle within the trestle alignment portion. While each bent is suspended vertically from its top cap (24), its legs (25) may be bonded in place with cement (58).

Figure 10A:
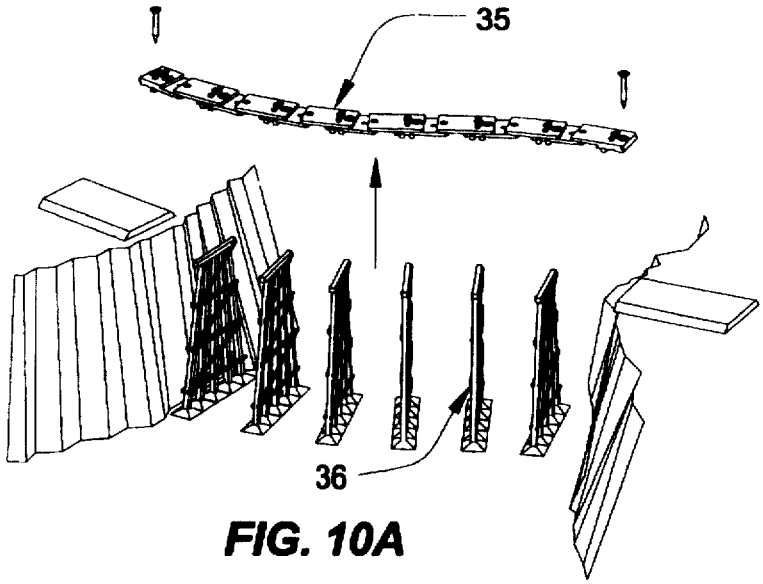
FIG. 10 illustrates the installment of model railroad track on trestles.
Figure 10B:
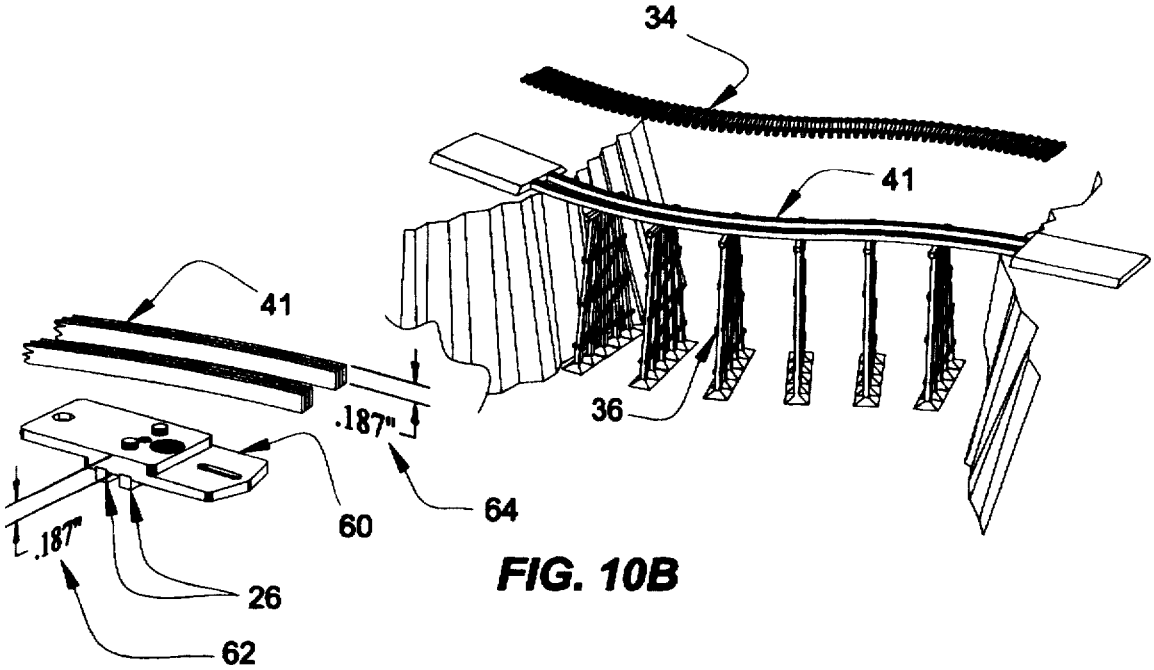
Figure 10C:
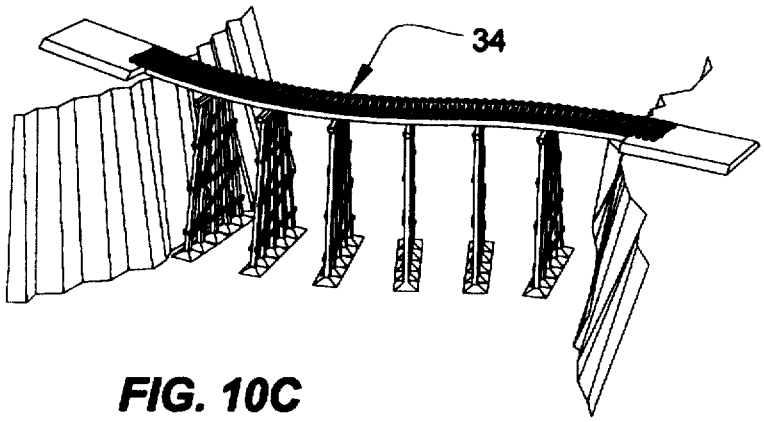

FIG. 10 illustrates the positioning of the track on top of the trestle. FIG. 10*a* shows the trestles (36) with the track alignment chain (35) removed. The scenery around the base of the trestle is completed and cross bracing (not shown) may be installed at this time. FIG. 10*b* shows the stringers (41) installed on the tops of the trestles (36). The member thickness (62) proximate the top cap registration feature (26) preferably is substantially equal to the stringer height (64) so that the surface formed between the cork roadbed (54) and the stringers (41) is substantially level for mounting the track (34) as shown in FIG. 10*c*. As shown in FIG. 10*b*, in cases where HO scale is employed, the stringer height and the thickness (62) of the member proximate registration feature (26) are preferably about 0.187 in., however a number of other lengths may be employed instead. The thickness (62) of the head (30) is preferably substantially equal to the thickness of the roadbed section (54) proximate the head, and the thickness (62) of the tail (32) is preferably substantially equal to that of the roadbed section (54) proximate the tail. The steps shown in FIGS. 10*a* and 10*b* may be eliminated and the track (34) may be directly mounted to the top surface of the track alignment chain (35).

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A joint for supporting model railroad track, the joint comprising:

a first member and second member, the first and second members each comprising:

a frontal end;

a distal end;

a top surface having a top indention proximate the distal end;

a bottom surface having a bottom indention proximate the frontal end;

and wherein a pivotal connector connects the first member and the second member to form a pivotal engagement between the top indention of the first member and the bottom indention of the second member.

2. The joint of claim 1, further comprising a distal opening proximate the distal end, the distal opening adapted to receive and hold a connector;

a frontal opening proximate the frontal end, the frontal opening adapted to receive and hold a connector;

a central opening substantially between the frontal opening and the distal opening, the central opening adapted to receive and hold a connector;

and wherein the pivotal connector is positioned within the distal opening of the first member and the frontal opening of the second member to form the pivotal engagement.

3. The joint of claim 2 wherein the distal opening of the first member is an elongated slot adapted to allow movement of a connector within the slot in a direction substantially along the length of the first member.

4. The joint of claim 1, further comprising an engagement device located on the top surface of at least one of the members, the engagement device being adapted to fit within ties of a section of model railroad track to provide a fixable engagement between the section of model railroad track and at least one of the members.

5. The joint of claim 1 wherein the engagement device comprises a substantially rectangular section protruding from the top surface of at least one of the members.

6. The joint of claim 1 wherein the engagement device comprises two sections protruding from the top surface of at least one of the members.

7. The joint of claim 1, further comprising a trestle indention on the bottom surface of at least one of the members, the trestle indention being configured to receive a portion of a model railroad trestle.

8. The joint of claim 1, further comprising a connector extending from the top surface of one of the joint members, the connector being adapted to fixably engage one of the joint members to at least one tie of a model railroad track.

9. The joint of claim 1, further comprising an opening in at least one of the members, the opening being adapted to receive and hold a connector to form a fixable engagement between at least one of the members and a model railroad layout base.

10. The joint of claim 1, further comprising a trestle alignment portion comprising two trestle alignment protrusions, the trestle alignment portion configured to receive a portion of a model railroad trestle between the trestle alignment protrusions.

11. The joint of claim 1, wherein the pivotal connector is adjustable to inhibit the pivoting of the first member relative to the second member such that a pre-determined angle is formed between the first member and the second member.

12. The joint of claim 1 wherein the first member is adapted to pivot relative to the second member in a horizontal plane substantially parallel to the top surface of at least one of the members such that an angle greater than 0° and less than about 20° is formed between the first member and the second member.

13. A model railroad track system, comprising:

(i) a joint for supporting model railroad track, the joint comprising:

a first member comprising:

a frontal end;

a distal end;

a top surface having a top indention proximate the distal end; and a bottom surface;

a second member, comprising:

a frontal end;

a distal end;

a top surface; and a bottom surface having a bottom indention proximate the frontal end; and a connector proximate the frontal end, the connector providing a pivotal engagement between the bottom indention of the second member and the top indention of the first member;

(ii) model railroad track comprising a plurality of ties, the model railroad track being fixably engaged to the joint;

(iii) a model railroad trestle having a top cap; and (iv) a trestle alignment portion on the bottom surface of at least one of the members of the joint, the trestle alignment portion comprising two protrusions, and wherein the top cap of the trestle is engaged with the trestle alignment portion and between the protrusions such that a substantially perpendicular angle is formed between the top cap and a longitudinal axis of the model railroad track.

14. A member for positioning a model railroad trestle, the member comprising:

a frontal end;

a distal end;

a top surface having a top indention proximate the distal end;

a bottom surface having a bottom indention proximate the frontal end;

a pivotal connector proximate the distal end, the connector adapted to provide a pivotal engagement between the top indention and a portion of another joint member; and a trestle alignment portion formed on the bottom surface, the trestle alignment portion conformed to maintain a model railroad trestle in fixed position.

15. A joint for supporting model railroad track, comprising:

a first member comprising a distal end;

a second member comprising a frontal end;

a connector for connecting the distal end of the first member to the frontal end of the second member, the connector providing a pivotal engagement between the first member and the second member during use;

an engagement device located on an upper surface of at least one of the first and second members, the engagement device being adapted to engage at least one tie of a section of model railroad track to provide a fixable engagement between the section of model railroad track and at least one of the members during use; and a trestle alignment portion for receiving a top cap of a model railroad trestle, the trestle alignment portion being located on a lower surface of at least one of the first and second members and comprising two sections sized to fit on opposite sides of the top cap during use.

16. The joint of claim 15 wherein the engagement device comprises a protruding section adapted to fit between a pair of ties of the section of model railroad track.

17. The joint of claim 15 wherein the sections of the trestle alignment portion form a channel, and wherein the top cap is adapted to fit within the channel such that a substantially perpendicular angle is formed between the top cap and a lower surface of at least one of the members during use.

18. The joint of claim 15, further comprising a second connector for connecting a frontal end of the first member with a distal end of a third member such that a pivotal engagement is formed between the first member and the third member about the second connector.

19. The joint of claim 15 wherein the connector comprises a substantially elongated section extending from the frontal end of the second member, and wherein the first member comprises an elongated slot shaped to receive a head of the elongated section, the head being adapted to move within the elongated slot to pivot the second member with respect to the first member about the head during use.

20. A joint for supporting a model railroad track, comprising:

a first member comprising a frontal end; a distal end, a tongue extending from the frontal end, and a groove disposed in the distal end, the tongue being substantially elongated and comprising a substantially circular-shaped head, the groove being substantially elongated and shaped to receive a tongue of another member such that a pivotal engagement is provided between the first member and the other member; and a second member comprising a frontal end, a distal end, a tongue extending from the frontal end, and a groove disposed on the distal end, the tongue being substantially elongated and comprising a substantially circular-shaped head, the groove being substantially elongated and shaped to receive the head of the first member such that a pivotal engagement is provided between the first member and the second member substantially about the head of the tongue of the first member during use.

21. The joint of claim 20, further comprising a trestle alignment portion on the lower surface of at least one of the members, the trestle alignment portion comprising two sections sized to fit on opposite sides of a top cap of a model railroad trestle such that a substantially perpendicular angle is formed between the top cap and the lower surface during use.

22. The joint of claim 20, further comprising an engagement device located on an upper surface of at least one of the first and second members, the engagement device being adapted to engage at least one tie of a section of model railroad track to provide a fixable engagement between the section of model railroad track and at least one of the members during use.

* * * * *